US011289061B2

(12) United States Patent
Conway, Jr.

(10) Patent No.: US 11,289,061 B2
(45) Date of Patent: Mar. 29, 2022

(54) VARIABLE WIND GUITAR PICKUP

(71) Applicant: Robert E. Conway, Jr., Indpls., IN (US)

(72) Inventor: Robert E. Conway, Jr., Indpls., IN (US)

( * ) Notice: Subject to any disclaimer, the term of this patent is extended or adjusted under 35 U.S.C. 154(b) by 0 days.

(21) Appl. No.: 16/912,405

(22) Filed: Jun. 25, 2020

(65) Prior Publication Data

US 2021/0407485 A1 Dec. 30, 2021

(51) Int. Cl.
*G10H 3/18* (2006.01)

(52) U.S. Cl.
CPC ..... *G10H 3/181* (2013.01)

(58) Field of Classification Search
CPC ..... G10H 3/181
USPC ..... 84/726
See application file for complete search history.

(56) References Cited

U.S. PATENT DOCUMENTS 2,119,584 A * 6/1938 Knoblaugh ..... G10H 3/181 984/368
4,364,295 A * 12/1982 Stich ..... G10H 3/181 984/368
4,534,258 A * 8/1985 Anderson ..... G10H 3/182 984/369
4,809,578 A * 3/1989 Lace, Jr. ..... G10H 3/181 984/368
5,464,948 A * 11/1995 Lace ..... G10H 3/181 84/726
5,789,691 A * 8/1998 Stich ..... G10H 3/181 84/726
6,253,654 B1 * 7/2001 Mercurio ..... G10D 1/085 84/293
9,704,464 B1 * 7/2017 Petschulat ..... G10H 3/185
9,773,488 B2 * 9/2017 Wolf ..... G10H 3/183
10,002,599 B1 * 6/2018 Wolf ..... G10H 3/183
10,446,130 B1 * 10/2019 Shaw ..... G10H 3/143
10,720,133 B2 * 7/2020 Shaw ..... G10H 3/22
2005/0150365 A1 * 7/2005 Krozack ..... G10H 3/181 84/726
2006/0156911 A1 * 7/2006 Stich ..... G10H 3/181 84/726
2014/0202319 A1 * 7/2014 Osborne ..... G10H 3/181 84/728
2014/0245877 A1 * 9/2014 Gelvin ..... G10H 3/181 84/727
2018/0108335 A1 * 4/2018 Cudney ..... G10H 3/181
2020/0058280 A1 * 2/2020 Shaw ..... G10H 3/143
2021/0407485 A1 * 12/2021 Conway, Jr. ..... G10H 3/181

OTHER PUBLICATIONS

Jeff Owens, Coil Tapping vs. Coil Splitting: The Tone Option Hidden in your Pickups, Fender, https://www.fender.com/articles/tech-talk/the-tone-option-that-could-be-hidden-in-your-pickups, accessed Jul. 29, 2021 (Year: 2021).*

(Continued)

*Primary Examiner* — Christina M Schreiber
(74) *Attorney, Agent, or Firm* — Barnes & Thornburg LLP

(57) ABSTRACT

A process for making a variable wind guitar pickup and a variable wind guitar pickup made by the process is provided. The pickup is capable of many sounds by changing the number of windings using a selector switch such as a five-position or six-position selector switch.

16 Claims, 2 Drawing Sheets

(56) References Cited

OTHER PUBLICATIONS

Coil Tapping vs. Coil Splitting: The Tone Option Hidden in your Pickups, Wayback address; https://web.archive.org/web/20201111231555/https://www.fender.com/articles/tech-talk/the-tone-option-that-could-be-hidden-in-your-pickups, published Nov. 11, 2020 (Year: 2020).*

Seymour Duncan, Tapping into Versatility With a Tapped Single Coil, https://www.seymourduncan.com/blog/latest-updates/tapping-into-versatility-with-a-tapped-single-coil (Year: 2020).*

* cited by examiner

VARIABLE WIND GUITAR PICKUP

BACKGROUND

It is known to have multiple guitar pickups with different windings to change sounds. Other guitar pickups may change the sound by switching the coils in and out of phase. Some pickup makers perform coil tapping by soldering two wires and taping them to the side of the pickup.

SUMMARY

A process for making a variable wind guitar pickup and a variable wind guitar pickup made by the process is provided. The pickup is capable of many sounds by changing the number of windings using a selector switch such as a five-position or six-position selector switch.

The process used to make a single coil guitar pickup includes winding a wire on a pickup bobbin. Multiple tapping points in the wound wire connect to a terminal board and separate wires, in turn, are each wired from the terminal board to a selector switch. For double coil (humbucker) pickups, wires are wound on the separate bobbins and connected to two selector switches via respective terminal boards. The wire from the terminal board to the selector switch is larger than the pickup coil wire.

According to the present disclosure, a process of making a variable wind guitar pickup apparatus is provided. The process includes winding a first wire on a pickup bobbin for a first preset number of winds, connecting the first wire having the first preset number of winds to a terminal board, winding the first wire on the pickup bobbin for a second preset number of winds, connecting the first wire having the second preset number of winds to the terminal board, and situating the terminal board in juxtaposition with a back surface of a base plate of the pickup bobbin such that no portion of the terminal board extends beyond a perimeter edge of the base plate.

The process further includes connecting a multi-position selector switch to a plurality of terminals that each extend from the terminal board. Connecting the multi-position selector switch to the plurality of terminals includes connecting a plurality of connecting wires to the terminals and to switch terminals of the multi-position selector switch. The multi-position selector switch includes a five-position switch or a six-position switch in the illustrative embodiments.

In an illustrative embodiment, each terminal of the plurality of terminals that extend from the terminal board is parallel with a plurality of slots in the base plate of the pickup bobbin. A number of the slots in the base plate is equal to a number of the terminals extending from the terminal board.

In an illustrative embodiment, the plurality of slots are located adjacent one elongated edge of the terminal board and the plurality of terminals are located adjacent an opposite elongated edge of the terminal board. Each slot of the plurality of slots comprises a straight slot. The plurality of slots are each parallel to one another.

The perimeter edge of the base plate includes a nonlinear edge at which the plurality of slots are open. The nonlinear edge has an apex portion and an equivalent number of slots are provided on either side of the apex portion. For example, three slots are provided on either side of the apex portion.

The process further includes winding the first wire on the pickup bobbin for a third preset number of winds and connecting the first wire having the third preset number of winds to the terminal board. The process further includes winding the first wire on the pickup bobbin for a fourth preset number of winds and connecting the first wire having the fourth preset number of winds to the terminal board. The process further includes winding the first wire on the pickup bobbin for a fifth preset number of winds and connecting the first wire having the fifth preset number of winds to the terminal board.

The present disclosure contemplates a single coil guitar pickup that includes the variable wind guitar pickup apparatus made by the process described above. The present disclosure further contemplates a double coil guitar pickup including the variable wind guitar pickup apparatus made by the process described above.

DETAILED DESCRIPTION

Figure 1:
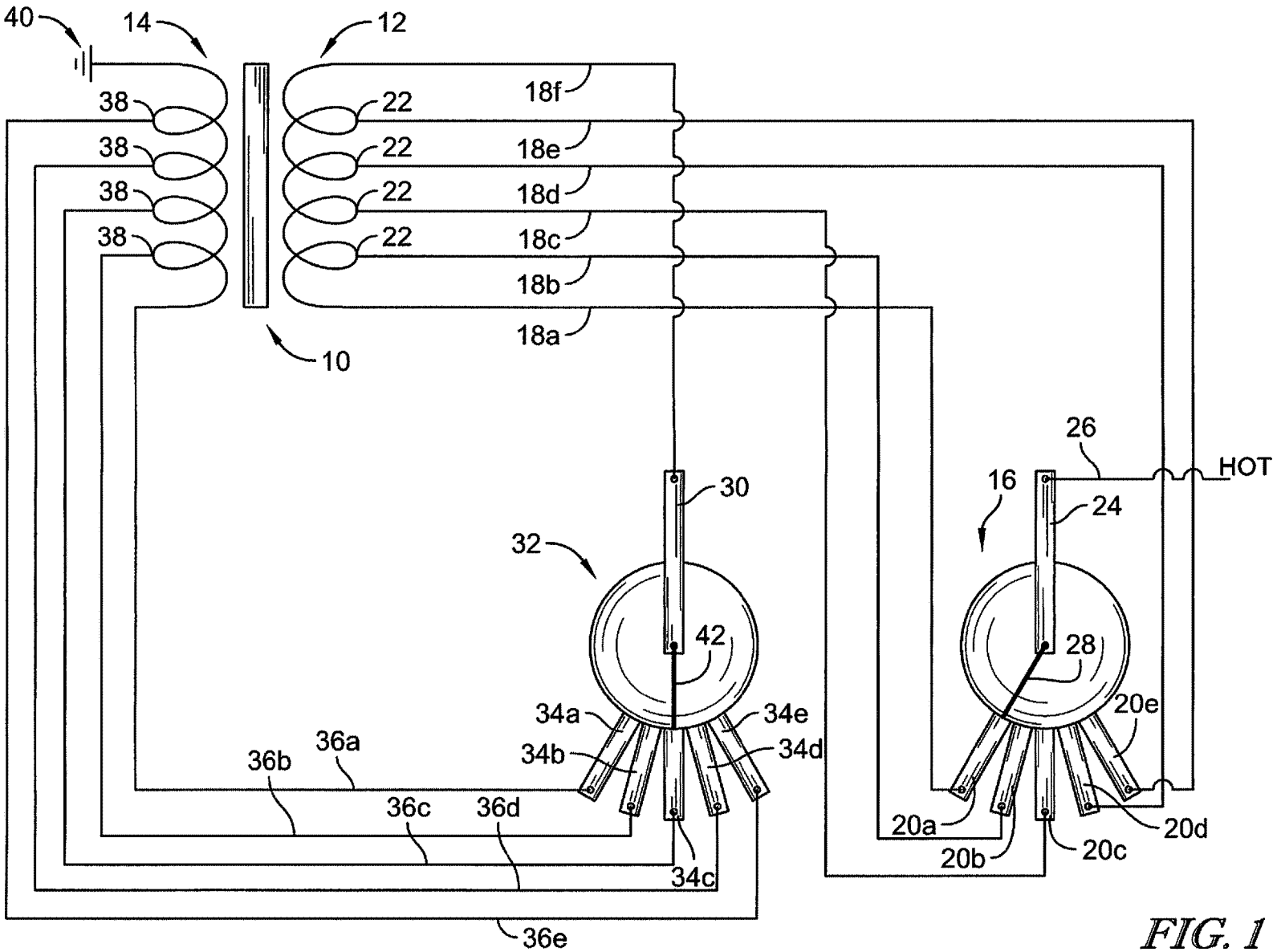
FIG. 1 is a diagrammatic view of a double coil variable wind guitar pickup having portions of each coil of the double coil wired to a respective five-way selector switch.

Referring to FIG. 1, a double coil variable wind guitar pickup 10 has a first coil of wire 12 and a second coil of wire 14, each having multiple windings or winds. The first coil of wire 12 is coupled to a 5-position selector switch 16 via wires 18*a*, 18*b*, 18*c*, 18*d*, 18*e* that, in turn, connect to respective switch terminals 20*a*, 20*b*, 20*c*, 20*d*, 20*e*. Wire 18*a* is an electrical extension of one end of coil of wire 12, whereas wires 18*b*, 18*c*, 18*d*, 18*e* couple electrically to coil of wire 12 at respective tapping points 22. Switch 16 has a hot terminal 24 that selectively couples to each of the five switch terminals 20*a*, 20*b*, 20*c*, 20*d*, 20*e* via use of a movable element 28 of switch 16. Hot terminal 24 connects to a hot wire 26. A wire 18*f* couples another end of coil of wire 12 and to a hot terminal 30 of a second five-position selector switch 32. Switch 32 has five switch terminals 34*a*, 34*b*, 34*c*, 34*d*, 34*e* that couple to respective wires 36*a*, 36*b*, 36*c*, 36*d*, 36*e*. Wire 36*a* is an electrical extension of one end of coil of wire 14, whereas wires 36*b*, 36*c*, 36*d*, 36*e* couple electrically to coil of wire 14 at respective tapping points 38. Another end of second coil of wire 14 couples to ground 40.

The positions of selector switches 16, 32 determine the number of windings of coils 12, 14 through which current flows to produce the sound of pickup 10. Thus, in the illustrative embodiment, there are 25 total possible combinations of positions at which selector switches 16, 32 can be placed. In FIG. 1, selector switch 16 is in a position having contact element 28 at a first position in which terminal 20*a* is coupled to terminal 24 which, in turn, corresponds to all of the windings of coil of wire 12 contributing to the sound of pickup 10. Also in FIG. 1, selector switch 32 is in a position having a contact element 42 at a third position in which terminal 34*c* is coupled to terminal 30 which, in turn, corresponds to the windings of coil of wire 14 between tapping point 38 of wire 36*c* and ground 40 contributing to the sound of pickup 10. Terminals 20*b*, 20*c*, 20*d*, 20*e* correspond to respective second, third, fourth, and fifth positions of contact element 28 of switch 16. Similarly, terminals 34*a*, 34*b*, 34*d*, 34*e* correspond to respective first, second, fourth, and fifth positions of contact element 42 of switch 32.

Figure 2A:
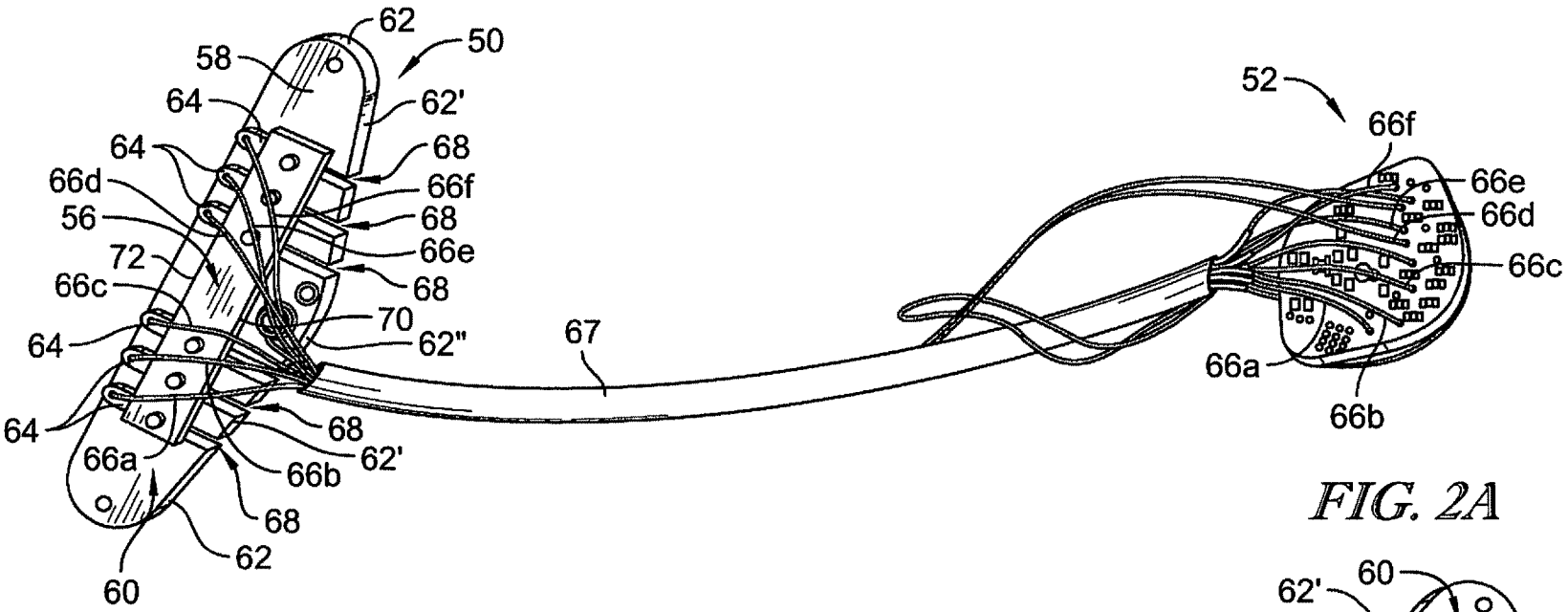
FIG. 2A is a perspective view of a back of a single coil variable wind pickup, an associated selector switch, and a cable having wires interconnecting the selector switch and a terminal board at a back of a base plate of a bobbin of the single coil variable wind guitar pickup.
Figure 2B:
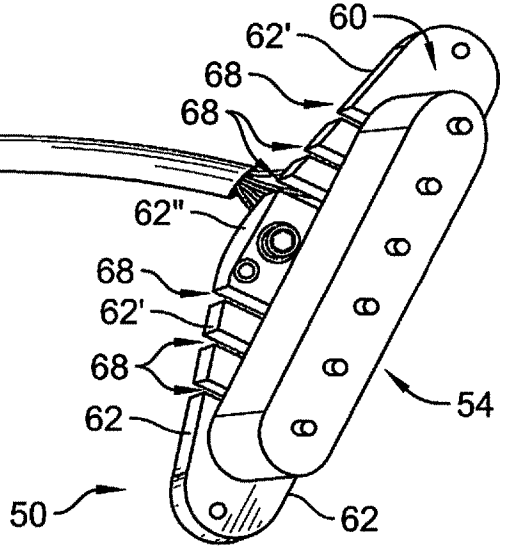
FIG. 2B is perspective view of a front of the single coil variable wind pickup, the selector switch, and the cable of FIG. 2A.

In FIG. 2A, a back of a single coil variable wind pickup 50 is shown and in FIG. 2B a front of the pickup 50 is shown. Instead of two coils of wire like coils of wire 12, 14 of pickup 10 of FIG. 1, pickup 50 only has one coil of wire (not shown, but similar to coil of wire 12). Another difference between pickup 10 and pickup 50 is that six different numbers of windings of wire of the coil of wire are selectable for contributing to the sound of pickup 50. Thus, a six-position selector switch 52 is used with pickup 50. However, the features discussed above in connection with pickup 10 that are in common with pickup 50 are discussed below using like reference numbers where appropriate.

According to the present disclosure, a process of making a variable wind guitar pickup apparatus 10, 50 is provided. The process includes winding a first wire 12 on a pickup bobbin 54 for a first preset number of winds, connecting the first wire 12 having the first preset number of winds to a terminal board 56, winding the first wire 12 on the pickup bobbin 54 for a second preset number of winds, connecting the first wire 12 having the second preset number of winds to the terminal board 56, and situating the terminal board 56 in juxtaposition with a back surface 58 of a base plate 60 of the pickup bobbin 54 such that no portion of the terminal board 56 extends beyond a perimeter edge 62 of the base plate 60.

In the FIGS. 2A and 2B embodiment, the process further includes connecting multi-position selector switch 52 to a plurality of terminals 64 that each extend from the terminal board 56. Connecting the multi-position selector switch 52 to the plurality of terminals includes connecting a plurality of connecting wires 66*a*, 66*b*, 66*c*, 66*d*, 66*e*, 66*f* to the terminals 64 and to switch terminals (similar to switch terminals 20*a*-20*e*, but having six such switch terminals instead of five) of the multi-position selector switch 52. Wires 66*a-f* are gathered together within a cable 67 in the illustrative embodiment. The multi-position selector switch 52 includes a six-position switch in the illustrative embodiment but can include a five-position switch in other embodiments.

In the illustrative embodiment of FIGS. 2A and 2B, each terminal 64 of the plurality of terminals 64 that extend from the terminal board 56 is parallel with a plurality of slots 68 in the base plate of the pickup bobbin. A number of the slots 68 in the base plate 56 is equal to a number of the terminals 64 extending from the terminal board. This number is six in the illustrative example.

In the illustrative embodiment, the plurality of slots 68 are located adjacent one elongated edge 70 of the terminal board 56 and the plurality of terminals 64 are located adjacent an opposite elongated edge 72 of the terminal board. Each slot 68 of the plurality of slots 68 comprises a straight slot 68. The plurality of slots 68 are each parallel to one another.

The perimeter edge 62 of the base plate includes a nonlinear edge 62' at which the plurality of slots 68 are open. The nonlinear edge 62' has an apex portion 62" and an equivalent number of slots 68 are provided on either side of the apex portion 62". For example, three slots 68 are provided on either side of the apex portion 62".

The process further includes winding the first wire 12 on the pickup bobbin 54 for a third preset number of winds and connecting the first wire 12 having the third preset number of winds to the terminal board 56. The process further includes winding the first wire 12 on the pickup bobbin for a fourth preset number of winds and connecting the first wire 12 having the fourth preset number of winds to the terminal board 56. The process further includes winding the first wire 12 on the pickup bobbin for a fifth preset number of winds and connecting the first wire 12 having the fifth preset number of winds to the terminal board 56.

The present disclosure contemplates a single coil guitar pickup, as shown in FIGS. 2A and 2B, that includes the variable wind guitar pickup apparatus 50 made by the process described above. The present disclosure further contemplates a double coil guitar pickup, shown diagrammatically in FIG. 1, including the variable wind guitar pickup apparatus 10 made by the process described above.

A process used to make a single coil guitar pickup 50, therefore, includes winding a wire 12 on a pickup bobbin 54 and connecting various points in the windings to a terminal board 56. The terminal board 56 is connected by separate wires 66*a-f* to a selector switch 52. For double coil (humbucker) pickups, such as pickup 10, coils of wires 12, 14 are wound on the separate bobbins and connected to two selector switches 16, 32 via respective terminal boards. The wire, such as used in wires 66*a-f*, from the terminal board 56 to the selector switch 52 is larger than the pickup coil wire 12.

The invention claimed is:

1. A process of making a variable wind guitar pickup apparatus, the process comprising winding a first wire on a pickup bobbin for a first preset number of winds, connecting the first wire having the first preset number of winds to a terminal board, winding the first wire on the pickup bobbin for a second preset number of winds, connecting the first wire having the second preset number of winds to the terminal board, and situating the terminal board in juxtaposition with a back surface of a base plate of the pickup bobbin such that no portion of the terminal board extends beyond a perimeter edge of the base plate.

2. The process of claim 1, further comprising connecting a multi-position selector switch to a plurality of terminals that each extend from the terminal board.

3. The process of claim 2, wherein connecting the multi-position selector switch to the plurality of terminals comprises connecting a plurality of connecting wires to the terminals and to switch terminals of the multi-position selector switch.

4. The process of claim 2, wherein each terminal of the plurality of terminals that extend from the terminal board is parallel with a plurality of slots in the base plate of the pickup bobbin.

5. The process of claim 4, wherein a number of the slots in the base plate is equal to a number of the terminals extending from the terminal board.

6. The process of claim 4, wherein the plurality of slots are located adjacent one elongated edge of the terminal board and the plurality of terminals are located adjacent an opposite elongated edge of the terminal board.

7. The process of claim 4, wherein each slot of the plurality of slots comprises a straight slot.

8. The process of claim 4, wherein the plurality of slots are each parallel to one another.

9. The process of claim 4, wherein the perimeter edge of the base plate includes a nonlinear edge at which the plurality of slots are open, wherein the nonlinear edge has an apex portion, and wherein an equivalent number of slots are provided on either side of the apex portion.

10. The process of claim 9, wherein three slots are provided on either side of the apex portion.

11. The process of claim 2, wherein the multi-position selector switch comprises a five-position switch or a six-position switch.

12. The process of claim 1, further comprising winding the first wire on the pickup bobbin for a third preset number of winds and connecting the first wire having the third preset number of winds to the terminal board.

13. The process of claim 12, further comprising winding the first wire on the pickup bobbin for a fourth preset number of winds and connecting the first wire having the fourth preset number of winds to the terminal board.

14. The process of claim 13, further comprising winding the first wire on the pickup bobbin for a fifth preset number of winds and connecting the first wire having the fifth preset number of winds to the terminal board.

15. A single coil guitar pickup including the variable wind guitar pickup apparatus made by the process of claim 1.

16. A double coil guitar pickup including the variable wind guitar pickup apparatus made by the process of claim 1.

* * * * *